US011197520B2

(12) United States Patent
Takakuwa et al.

(10) Patent No.: US 11,197,520 B2
(45) Date of Patent: Dec. 14, 2021

(54) FIXING BELT, FIXING METHOD, AND FIXING BELT MEMBER

(71) Applicant: Kuraray Fastening Co., Ltd., Osaka (JP)

(72) Inventors: Kazunori Takakuwa, Fukui (JP); Yoshikatsu Fujisawa, Fukui (JP); Shiro Ogawa, Tokyo (JP)

(73) Assignee: Kuraray Fastening Co., Ltd., Osaka (JP)

( * ) Notice: Subject to any disclaimer, the term of this patent is extended or adjusted under 35 U.S.C. 154(b) by 0 days.

(21) Appl. No.: 16/480,094

(22) PCT Filed: Feb. 8, 2018

(86) PCT No.: PCT/JP2018/004298
§ 371 (c)(1),
(2) Date: Jul. 23, 2019

(87) PCT Pub. No.: WO2018/147347
PCT Pub. Date: Aug. 16, 2018

(65) Prior Publication Data

US 2019/0373988 A1 Dec. 12, 2019

(30) Foreign Application Priority Data

Feb. 10, 2017 (JP) ..... JP2017-023090

(51) Int. Cl.
*A44B 18/00* (2006.01)
*A44B 13/00* (2006.01)
*A44B 11/28* (2006.01)

(52) U.S. Cl.
CPC ..... *A44B 13/0035* (2013.01); *A44B 11/28* (2013.01); *A44B 18/0015* (2013.01)

(58) Field of Classification Search
CPC .. A44B 13/0035; A44B 11/28; A44B 18/0015
See application file for complete search history.

(56) References Cited

U.S. PATENT DOCUMENTS 2,861,547 A * 11/1958 Dale ..... A01K 27/003 119/797
3,710,425 A * 1/1973 Brumlik ..... A44B 18/0015 24/447

(Continued)

FOREIGN PATENT DOCUMENTS

CN 1328424 A 12/2001
CN 1798509 A 7/2006

(Continued)

OTHER PUBLICATIONS

PCT International Preliminary Report English Translation (Year: 2017).*

(Continued)

*Primary Examiner* — Jason W San
(74) *Attorney, Agent, or Firm* — Oblon, McClelland, Maier & Neustadt, L.L.P.

(57) ABSTRACT

A fixing belt which includes: a double-sided hook surface fastener having hook-like engaging elements on both surfaces thereof; and a double-sided loop surface fastener having loop-like engaging elements on both surfaces thereof. The double-sided hook surface fastener is an extrusion molding surface fastener, the double-sided hook surface fastener is folded back in a length direction in a shape of an alligator's mouth, and the double-sided hook surface fastener is fixed to a first mounting object at a folded-back portion by a rivet. One end portion of the double-sided loop surface fastener is tucked by the alligator's mouth, the double-sided loop surface fastener is folded back by an annular part fixed to a second mounting object, and the other end portion of the double-sided loop surface fastener engages with an outer side surface of the alligator's mouth.

11 Claims, 6 Drawing Sheets

(56) References Cited

U.S. PATENT DOCUMENTS 3,922,455 A * 11/1975 Brumlik ..... A44B 18/0015 428/85
3,994,048 A * 11/1976 Rosenthal ..... A63C 11/025 24/306
4,180,890 A * 1/1980 Brumlik ..... A44B 18/0015 24/449
4,431,226 A * 2/1984 Weilert ..... A45F 3/14 294/150
4,498,615 A * 2/1985 Johnson ..... A63B 57/203 224/274
4,759,963 A * 7/1988 Uso, Jr. ..... A01K 97/08 224/901.4
4,862,563 A * 9/1989 Flynn ..... A44B 18/00 24/442
5,104,076 A * 4/1992 Goodall, Jr. ..... A45F 5/02 224/251
5,133,112 A * 7/1992 Gomez-Acevedo ..... A44B 18/0003 24/306
5,136,759 A 8/1992 Armour, II
5,174,483 A * 12/1992 Moore, IV ..... A45F 5/02 224/250
5,289,619 A * 3/1994 Pileggi ..... A44B 18/00 24/17 AP
5,548,871 A * 8/1996 Trethewey ..... A44B 18/00 24/16 R
5,634,245 A * 6/1997 Rouser ..... A44B 18/0053 24/452
5,671,517 A * 9/1997 Gourley ..... A43B 3/0078 24/306
5,769,290 A * 6/1998 Pestana ..... A44C 5/0053 224/165
5,785,011 A * 7/1998 Gitterman, III ..... B68B 1/02 119/865
D401,137 S * 11/1998 Boelling ..... D8/394
6,029,321 A * 2/2000 Fisher ..... F41C 33/001 124/35.2
6,049,953 A * 4/2000 McCay ..... F16B 45/00 24/302
6,145,715 A * 11/2000 Slonim ..... A47G 23/0225 224/148.3
6,317,933 B1 * 11/2001 Suenaga ..... A44B 18/0088 24/16 R
6,449,815 B1 * 9/2002 Spiller ..... A01K 27/001 119/792
6,502,290 B1 * 1/2003 Tseng ..... A44B 18/0015 28/161
6,588,073 B1 * 7/2003 Zoromski ..... A44B 18/0015 24/446
6,606,768 B2 * 8/2003 Henry ..... A45F 5/00 24/298
6,767,169 B2 * 7/2004 Zhan ..... B60P 7/0823 410/100
6,896,458 B1 * 5/2005 Romero ..... B60P 7/0823 410/100
6,978,918 B2 * 12/2005 Scanlan ..... A45C 13/30 224/148.6
7,219,405 B1 * 5/2007 Nevens ..... A41F 11/04 24/306
7,284,505 B1 * 10/2007 Paxton ..... A01K 27/00 119/792
7,322,780 B2 * 1/2008 Hill ..... B60P 3/079 410/23
8,069,540 B2 * 12/2011 Obiols ..... F16L 3/137 24/306
D694,478 S * 11/2013 Ali ..... D30/153
8,573,458 B1 * 11/2013 Hamilton ..... A45F 5/021 224/250
D699,405 S * 2/2014 McKinnell ..... D30/152
8,727,914 B2 * 5/2014 Sells ..... A63B 69/0002 206/315.1
D729,615 S * 5/2015 Rothbaum ..... D8/356
9,302,606 B2 * 4/2016 Danze ..... B60P 7/0823
9,360,274 B2 * 6/2016 Horwitz ..... F41C 33/002
10,421,386 B2 * 9/2019 Sauerwald ..... B60P 7/06
2002/0092138 A1 * 7/2002 Spiller ..... A01K 27/002 24/306
2004/0172792 A1 * 9/2004 Kurtz, Jr. ..... A44B 18/0003 24/442
2006/0032032 A1 * 2/2006 Cheng ..... F16L 3/233 24/306
2007/0095870 A1 * 5/2007 Griffith ..... A45C 13/30 224/219
2008/0155798 A1 * 7/2008 Efremova ..... A44B 18/0015 24/442
2009/0159172 A1 * 6/2009 Tanno ..... B29D 30/20 152/548
2010/0180407 A1 7/2010 Rocha
2010/0181817 A1 * 7/2010 Tanaka ..... D04B 21/16 297/452.48
2010/0257703 A1 * 10/2010 Vass ..... A44B 18/0073 24/306
2010/0319167 A1 * 12/2010 Nirmel ..... A44B 18/0084 24/306
2012/0023711 A1 * 2/2012 Neumann ..... B60P 7/0823 24/265 H
2012/0321837 A1 * 12/2012 Adam ..... F16B 5/07 428/100
2013/0160250 A1 * 6/2013 Lecluyse ..... A44B 18/0069 24/444
2013/0318756 A1 * 12/2013 Becker ..... A43C 7/005 24/712.3
2014/0182084 A1 * 7/2014 Hill ..... B60P 7/0823 24/115 H
2014/0264996 A1 9/2014 Rocha
2015/0250271 A1 * 9/2015 Ogilvie ..... A44B 18/00 24/444
2016/0183639 A1 * 6/2016 Galu, Jr. ..... A44B 18/008 29/426.1
2017/0196739 A1 * 7/2017 Jakusch ..... A44B 18/0015
2017/0265602 A1 9/2017 Rocha
2017/0265603 A1 * 9/2017 Ronsen ..... A44B 18/0011
2020/0069005 A1 * 3/2020 Lima ..... A44B 18/0096
2020/0288820 A1 * 9/2020 Johnson ..... A44B 11/18

FOREIGN PATENT DOCUMENTS

CN 102946754 A 2/2013
CN 204473501 U 7/2015
CN 204909847 U 12/2015
EP 2 379 308 A1 10/2011
JP 51-16510 2/1976
JP 52-157906 11/1977
JP 55-122612 9/1980
JP 2005-27981 A 2/2005
JP 2005-278893 A 10/2005
JP 2011-30814 A 2/2011
JP 2016-108033 A 6/2016
WO WO 2014/196005 A1 12/2014

OTHER PUBLICATIONS

International Search Report dated Mar. 27, 2018 in PCT/JP2018/004298 filed on Feb. 8, 2018.
Extended European Search Report dated Dec. 10, 2019 in European Patent Application No. 18751891.5, 6 pages.
Combined Chinese Office Action and Search Report dated Jun. 1, 2021 in Chinese Patent Application No. 201880008788.7 (with English translation), 18 pages.

* cited by examiner

FIXING BELT, FIXING METHOD, AND FIXING BELT MEMBER

TECHNICAL FIELD

The present invention relates to a fixing belt, a fixing method which uses the fixing belt, and a belt member which forms the fixing belt.

BACKGROUND ART

Conventionally, as an example of means for mounting and fixing an object to a target object, there has been used a method in which a male surface fastener having hook-like engaging elements is fixed to a surface of either one of the object or the target object, a loop surface fastener having loop-like engaging elements is fixed to a surface of the other object, and both surface fasteners are made to overlap with each other so as to make both engaging elements engage with each other, thus mounting and fixing the object to the target object.

A belt for fixing by sandwiching one surface fastener by the other surface fastener using the above-mentioned fixing method has been used in various situations. Conventionally, such a fixing belt adopts a method in which a surface fastener is mounted on a belt end portion.

For example, as a packing member, a coil-like product packing member with the following configuration is known (Patent Literature 1). The coil-like product packing member includes: a sheet which covers an outer periphery and a side surface of the coil-like product on an inner surface side; a belt-like member which is mounted on at least one side edge of the sheet, extends from the sheet side edge, and has an inner surface on which a first surface fastener is mounted; and a second surface fastener which is mounted on an outer surface of the sheet and is joined to the first surface fastener by face joining. These surface fasteners are fixed to a belt end portion by sewing.

There has been also reported a method where, in a polishing belt of a lifting and feeding device while polishing pachinko balls, a surface fastener is mounted on a start end portion and a finish end portion of the polishing belt, and the start end portion and the finish end portion of the polishing belt are connected to each other by making the surface fastener at the start end portion and the surface fastener at the finish end portion engage with each other (Patent Literature 2). These surface fasteners are mounted on the belt end portions by sewing.

There has been also reported a fixedly mounting portion of a band where the band is engaged by sandwiching a loop surface between hook surfaces of a hook-and-loop fastener (Patent Literature 3).

Further, there has been also reported a connecting jig where two double-sided hook surface fasteners each having a hinge portion at the center thereof and having hook-like engaging elements on both front and back surfaces on left and right sides of the center respectively are manufactured by injection molding, and obtained molded product is bent in a U shape using the hinge portion as a center portion. In such a connecting jig, a belt attached with the double-sided loop surface fastener having loop-like engaging elements on both surfaces thereof is tucked and engaged between two hook surface fasteners facing each other in a U shape, the belt is wound around a mounting object, and the belt is wound around and fixed to the mounting object by making the loop-like engaging elements at the other end of the belt engage with the hook-like engaging elements at an outer side of the connecting jig (Patent Literature 4).

However, when the surface fastener is mounted only on the end portion of the belt as in the case of the prior art described above, there exists a drawback that the adjustment of a length of the belt or the like is difficult. Further, in the case where an engaging force is decreased due to the use of the belt for a long period, breaking of the belt or the like, it is necessary to exchange the surface fastener. However, in the prior art known heretofore, both the male surface fastener and the loop surface fastener are fixed to the end portion of the fixing belt occurs and hence, there exists a drawback that an exchange of both fasteners requires man-hours and also pushes up a cost.

With respect to a fixing belt which uses a surface fastener or the like, as described above, as a method of mounting the surface fastener on a belt end portion, adhesion by sewing, melting, an adhesive tape or the like has been adopted in general. However, for example, in a case where equipment such as an artificial arm or an artificial leg is fixed, there is a possibility that such an adhesion method is insufficient.

In the technique disclosed in the above-mentioned Patent Literature 4, a hinge portion is only a portion capable of being bent and hence, fatigue concentrates on the hinge portion due to repetition of engagement and peeling-off of the fastener thus giving rise to a drawback that the fastener is easily broken at this portion. In addition to such a drawback, there also exists a drawback that the double-sided hook surface fastener which engages with the loop surface fastener is an injection molded product and hence, the double-sided hook surface fastener is hard whereby the double-sided hook surface fastener hardly adheres with the loop surface fastener and, as a result, the fastener cannot acquire a high engaging force.

The present invention has been made in view of the above-mentioned circumstances, and it is an object of the present invention to provide a fixing belt having a surface fastener where adjustment of a belt and exchange of a surface fastener can be performed easily at a low cost. It is also an object of the present invention to provide a fixing belt where, even when the engagement and peeling-off of a surface fastener is repeated, the surface fastener is hardly broken, and a hook surface fastener and a loop surface fastener easily adhere to each other so that a high engaging force can be acquired.

CITATION LIST

Patent Literature

Patent Literature 1: JP 2016-108033 A
Patent Literature 2: JP 2011-30814 A
Patent Literature 3: JP S52-157906 U
Patent Literature 4: WO 2014/196005 A

SUMMARY OF INVENTION

The present inventors have made studies extensively to overcome the above-mentioned drawbacks, and as a result of the studies, the inventors have found that the above-mentioned object can be achieved by using a fixing belt having the configuration described below, and have completed the present invention by further making studies based on such finding.

That is, the fixing belt according to an aspect of the present invention is directed to a fixing belt including: a double-sided hook surface fastener having hook-like engaging elements on both surfaces thereof; and a double-sided loop surface fastener having loop-like engaging elements on both surfaces thereof, wherein the double-sided hook surface fastener is an extrusion molding surface fastener, the double-sided hook surface fastener being folded back in a length direction in a shape of an alligator's mouth and fixed to a mounting object (A) at a folded-back portion, one end portion of the double-sided loop surface fastener is tucked by the alligator's mouth, the double-sided loop surface fastener is folded back by an annular part fixed to a mounting object (B), and another end portion of the double-sided loop surface fastener engages with an outer side surface of the alligator's mouth.

A fixing method according to another aspect of the present invention is directed to a method for fixing a mounting object (B) to a mounting object (A) using an extrusion molding double-sided hook surface fastener having hook-like engaging elements on both surfaces thereof and a double-sided loop surface fastener having loop-like engaging elements on both surfaces thereof, wherein using the double-sided hook surface fastener being folded back in a length direction in a shape of an alligator's mouth and fixed to the mounting object (A) at a folded-back portion, the double-sided loop surface fastener fixes the mounting object (A) to the mounting object (B) in such a manner that one end portion of the double-sided loop surface fastener is tucked by the alligator's mouth, the double-sided loop surface fastener is folded back by an annular part fixed to the mounting object (B), and another end portion of the double-sided loop surface fastener engages with an outer side surface of the alligator's mouth.

A fixing belt member according to still another aspect of the present invention is directed to a fixing belt member in which a double-sided hook surface fastener having hook-like engaging elements on both surfaces thereof is folded back in a length direction in shape of an alligator's mouth, and a folded-back state of the double-sided hook surface fastener is fixed by a double-sided loop surface fastener inserted into a deep side of a folded-back portion, wherein in the double-sided hook surface fastener, the hook-like engaging elements are arranged on both surfaces of a substrate in an array in a surface fastener length direction, the hook-like engaging element is a T-shaped engaging element which consists of a stem portion and an umbrella portion expanding from an upper portion of the stem portion, the umbrella portion protruding beyond a width of the stem portion in a direction which intersects with an engaging element array direction, the substrate and the engaging elements consist of a same crystalline resin, and crystals of the resin which constitutes the substrate are oriented in the surface fastener length direction.

DESCRIPTION OF EMBODIMENTS

A preferred embodiment of the present invention is described hereinafter with reference to drawings. However, the present invention is not limited at all by these drawings, the description and the like, and respective constitutional elements can be modified within the technical scope of the present invention.

Figure 3:
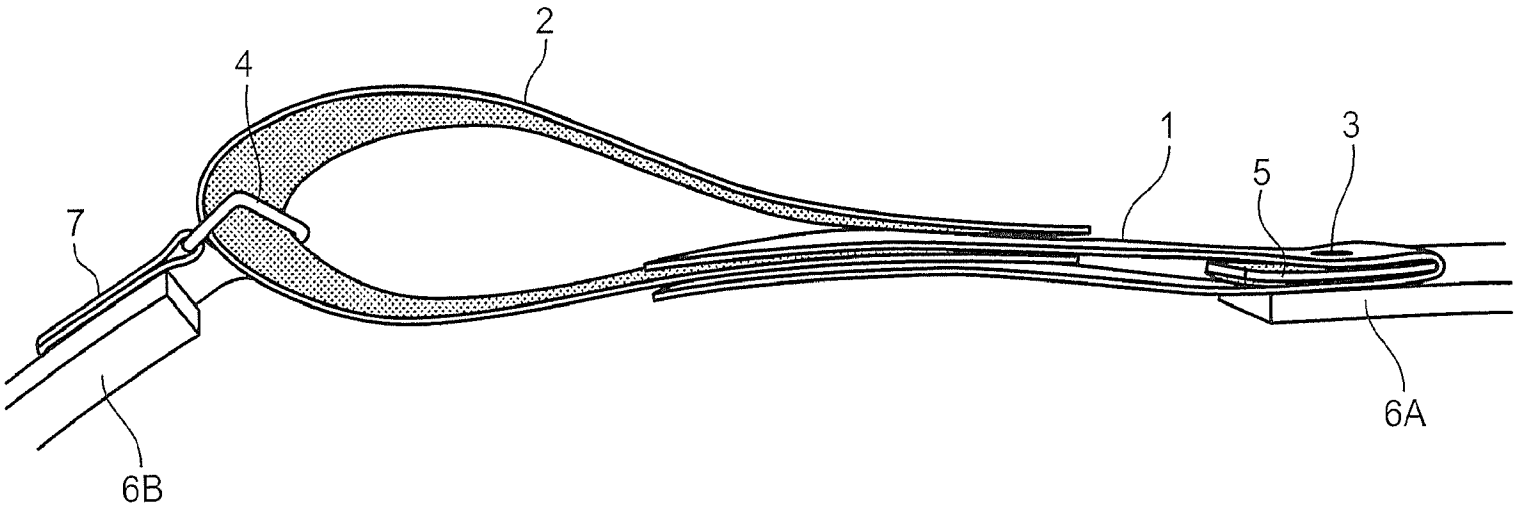
FIG. 3 is a schematic view showing one example of the fixing belt of this embodiment.

In the respective drawings, symbols indicate the following constitutional elements respectively. 1: double-sided hook surface fastener, 2: double-sided loop surface fastener, 3: rivet, 4: annular metal part, 5: reinforcing member, 6A: mounting object (A), 6B: mounting object (B), 7: mounting object connecting member, 11: substrate, 12: hook-like engaging element, 13: stem portion, 14: umbrella portion, W: width of umbrella portion, C: flow direction of double-sided hook surface fastener As shown in FIG. 3, the fixing belt of this embodiment consists of a fixing belt including: a double-sided hook surface fastener 1 having hook-like engaging elements on both surfaces thereof; and a double-sided loop surface fastener 2 having loop-like engaging elements on both surfaces thereof, for example. The double-sided hook surface fastener is folded back in a length direction thereof thus forming an alligator's mouth, and is fixed to a mounting object (A) 6A by a rivet 3 or the like at the folded-back portion. The double-sided loop surface fastener 2 has one end portion thereof tucked by the alligator's mouth, is folded back at an annular part 4 fixed to a mounting object (B) 6B, and has the other end portion thereof engaged with an outer side surface of the alligator's mouth.

With such a configuration, it is possible to easily adjust a length of the belt or the like. Further, when an engaging force of the surface fastener is deteriorated due to long time use or the like, only the double-sided loop surface fastener 2 where deterioration is likely to occur before the double-sided hook surface fastener 1 is deteriorated can be easily exchanged in a state where the double-sided hook surface fastener 1 is kept in a fixed state. Accordingly, it is possible to acquire an advantageous effect that the surface fastener can be also exchanged efficiently at a low cost.

Usually, the deterioration of an engaging force of the surface fastener occurs in such a manner that filaments which form the loop-like engaging elements of the loop surface fastener are cut one after another due to the repetition of engagement and peeling-off of the surface fastener so that the engageability of the loop surface fastener is gradually dissipated. According to the belt of the present invention, fixing of the double-sided loop surface fastener is not performed except for when the double-sided loop surface fastener engages with the hook surface fastener and when the double-sided loop surface fastener is folded back at a ring which is an annular part and hence, the double-sided loop surface fastener can be exchanged extremely easily.

Further, the case of the previously-mentioned surface fastener formed by injection molding has a drawback that fatigue is concentrated and cumulated on a weak connecting portion between the surface fasteners due to the repetition of engagement and peeling-off of the surface fasteners so that the surface fastener is likely to be broken at such a portion. On the other hand, in the fixing belt of this embodiment, the tape-like extrusion molding double-sided hook surface fastener is used such that the double-sided hook surface fastener is folded back in an alligator's mouth shape. Accordingly, even when the engagement and the peeling-off of the double-sided hook surface fastener is repeated, the engagement and the peeling-off are uniformly distributed in a tape length direction and hence, there is no possibility that fatigue accumulates at a specific portion.

Further, in the fixing belt of this embodiment, the extrusion molding double-sided hook surface fastener tape is used in a folded back manner and hence, a hook surface is flexible. In addition, the hook surface fastener is easily brought into close contact with the loop surface fastener by pressing and hence, it is possible to acquire a high engaging force.

In the fixing band of this embodiment, a portion where the double-sided hook surface fastener 1 is used and a portion where the double-sided loop surface fastener 2 is used may be reversed compared to the above-mentioned configuration. That is, one-side end portion of the double-sided hook surface fastener 1 may be tucked by an alligator's mouth formed of the double-sided loop surface fastener 2. However, it is preferable that the loop surface fastener be arranged outside because it is possible to prevent the occurrence of an undesired adhesion of the fastener to clothes or the like. As described previously, the loop surface fastener is likely to be deteriorated earlier than the hook surface fastener due to the repetition of engagement and peeling-off of the surface fasteners. Accordingly, it is preferable to use the loop surface fastener as the easily exchangeable fastener.

The respective constitutional elements which form the fixing belt of this embodiment are described in detail.

Figure 1:
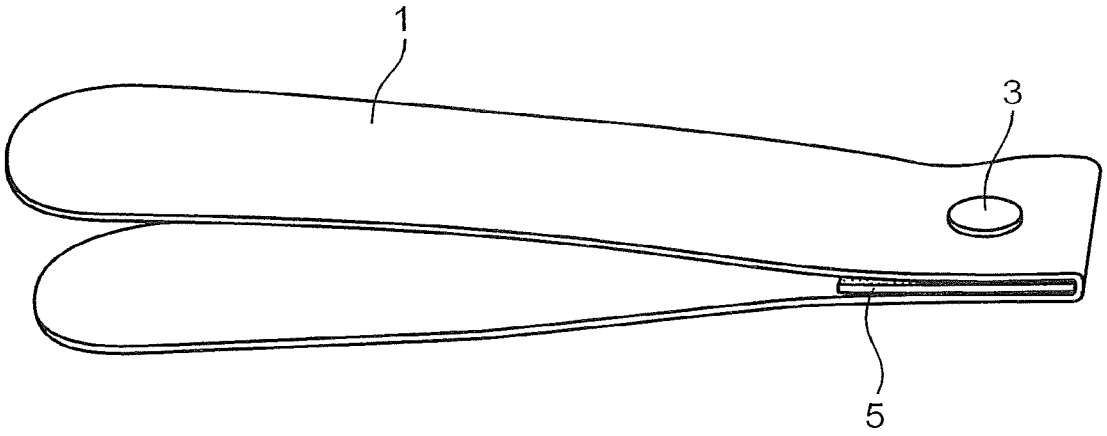
FIG. 1 is a schematic view showing one embodiment of an alligator's mouth formed of a double-sided hook surface fastener which forms a fixing belt of this embodiment.

As shown in FIG. 1, the double-sided hook surface fastener 1 of this embodiment is folded back at the center thereof thus forming an alligator's mouth, for example. It is preferable that the reinforcing member 5 be tucked by the folded-back portions. The reinforcing member is tucked at a deep side of the alligator's mouth, and portions other than the portion at the deep side of the double-sided hook surface fastener 1 are not covered by the reinforcing member so that the portions of the double-sided hook surface fastener 1 are engageable with the double-sided loop surface fastener inserted between the folded-back portions. In this embodiment, "deep side" of the alligator's mouth means a portion of the double-sided hook surface fastener 1 which is unnecessary to engage with the double-sided loop surface fastener. For example, "deep side" of the alligator's mouth means a region ranging from the folded-back portion of the double-sided hook surface fastener 1 to a portion of the double-sided hook surface fastener 1 which is fixed to the mounting object (A). Specifically, it is preferable to set a region ranging from the folded-back portion of the double-sided hook surface fastener 1 to a fixed portion as the deep side of the alligator's mouth. A length of the "deep side" may preferably be 1 to 4 cm from the folded-back portion.

The reinforcing member 5 is not particularly limited. For example, any reinforcing member can be used provided that the reinforcing member 5 can reinforce a portion of the double-sided hook surface fastener around a through hole for a retainer such as the rivet 3 formed in two double-sided hook surface fasteners in front of and behind the folded-back portion. As a conventionally known reinforcing member, artificial leather and natural leather can be named. However, there exists a drawback that artificial leather or natural leather pushes up a manufacturing cost.

Accordingly, in the case of this embodiment (the surface fastener forming the alligator's mouth being formed of the double-sided hook surface fastener), it is preferable to use a double-sided loop surface fastener as the reinforcing member 5. With such a configuration, a manufacturing cost can be suppressed. Further, it is also possible to acquire an advantageous effect that the reinforcing member can be temporarily fixed using a hook and loop engagement at the time of fixing the reinforcing member using the rivet 3 or the like, and the reinforcing member can be easily positioned compared to a reinforcing member which cannot be temporarily fixed. Further, the portions of the double-sided loop fasteners around the rivet-use through hole formed in the double-sided hook surface fasteners engage with the double-sided loop surface fastener which is inserted between two double-sided hook surface fasteners as the reinforcing member and hence, two double-sided hook surface fasteners in front of and behind the folded-back portion and the double-sided loop surface fastener inserted as the reinforcing member between two double-sided hook surface fasteners are integrally formed whereby the folded back portion is reinforced. With such a configuration, a force applied to the through hole can be dispersed to the double-sided hook surface fasteners and the double-sided loop surface fastener inserted between the integrally formed double-sided hook surface fasteners as the reinforcing member and hence, it is possible to prevent the double-sided hook surface fastener from being torn from the rivet-use through hole with high certainty.

As the double-sided loop surface fastener inserted as the reinforcing member, it is preferable to use a loop surface fastener having a harder base fabric layer than a usual loop surface fastener and having a larger thickness than the usual loop surface fastener for enhancing a reinforcing effect. Specifically, it is preferable to use a double-sided loop surface fastener formed by adhering base fabrics of two loop surface fasteners to each other using a hot-melt-type adhesive. With respect to a size of the reinforcing member, when the rivet is used as the retainer, it is preferable that the reinforcing member have a size capable of surrounding the periphery of the rivet-use through hole. Specifically, a length of the reinforcing member is preferably approximately 1 to 4 cm, and a width of the reinforcing member is preferably substantially equal to a width of the hook surface fastener.

A means for fixing the double-sided hook surface fastener to the mounting object (A) at the folded-back portion is not limited to a rivet. A method of fixing the double-sided hook surface fastener by a stapler, a method of fixing the double-sided hook surface fastener using a bolt and a nut, a method of fixing double-sided hook surface fastener by allowing the folded-back portion to pass through an annular part fixed to a mounting object, a method of fixing the double-sided hook surface fastener to the mounting object (A) using an adhesive agent or by sewing and the like can be named. Among these fixing methods, the fixing method using a rivet is particularly preferable since the simple and firm fixing can be acquired.

The rivet which can be used in this embodiment may be a rivet made of plastic or a rivet made of metal. the number of places where the rivet is provided is not limited to only one place in the folded-back portion, and the rivet may be mounted at plural places of the folded-back portion depending on a width of the fixing belt.

Figure 2:
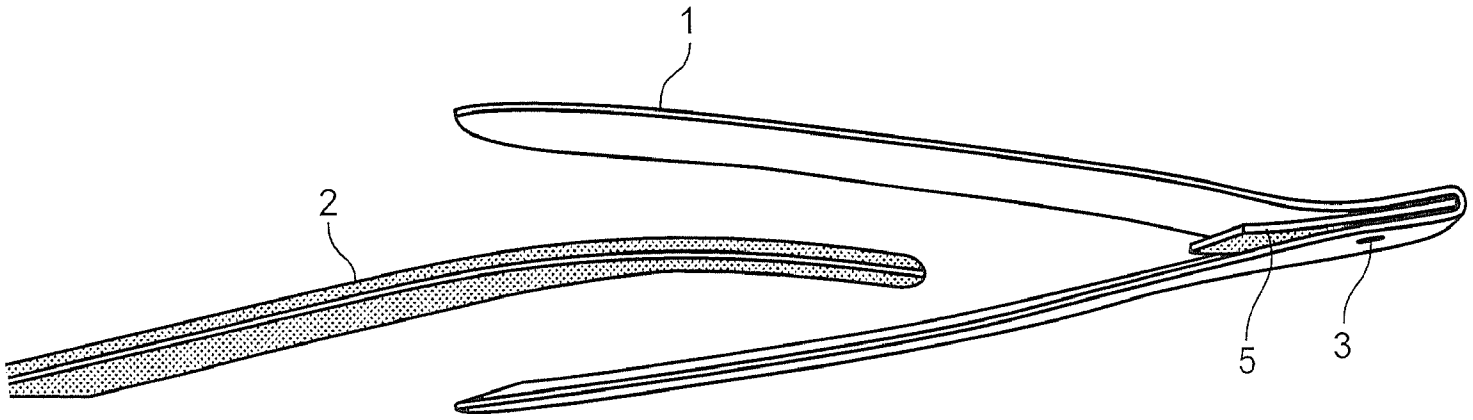
FIG. 2 is a schematic view showing one embodiment of the alligator's mouth formed of the double-sided hook surface fastener which forms the fixing belt of this embodiment, and a double-sided loop surface fastener tucked by the alligator's mouth.

In the fixing belt of this embodiment, as shown in FIG. 2, one end portion of the double-sided loop surface fastener 2 is tucked by the above-mentioned alligator's mouth formed by folding the double-sided hook surface fastener 1. A length of the belt can be easily adjusted by adjusting a length to a deep side of the alligator's mouth along which the double-sided loop surface fastener 2 is tucked by the alligator's mouth, a place of a hook surface which forms an outside of the alligator's mouth and is used for engagement of the double-sided loop surface fastener 2, or a length of a hook surface which forms an outside of the alligator's mouth and is used for engagement of the double-sided loop surface fastener 2.

As shown in FIG. 3, the double-sided loop surface fastener 2 is made to pass through the annular part 4 fixed to the mounting object (B) 6B, and is folded back, and a folded back end portion engages with the outer side surface of the alligator's mouth. In this embodiment, "end portion" does not mean an end portion in the exactly accurate meaning of the term, and includes a mode where a region ranging from the end portion to a portion close to a center portion. Further, "end portion" includes, a mode where the end portion is left in a non-engaging state for facilitating pinching the double-sided loop surface fastener 2 when necessary, a mode where an engaging element is removed from the end portion for facilitating pinching of the double-sided loop surface fastener 2 at the time of peeling off the double-sided loop surface fastener.

A method of fixing the annular part 4 to the mounting object (B) 6B is not particularly limited. However, the annular part 4 may be fixed to the mounting object (B) 6B by way of a member 7 fixed to the mounting object (B) 6B using a rivet or the like, for example.

The annular part 4 may be any part provided that the part allows the double-sided loop surface fastener 2 to pass therethrough with no trouble. For example, a D ring made of metal or a reinforced resin or the like can be used as the annular part 4.

The member 7 for mounting the annular part 4 on the mounting object (B) 6B is not particularly limited, and a metal-made plate, a resin-molded plate, a rubber-made molded plate, a textile fabric, a natural leather, an artificial leather or the like can be used as the member 7.

A length and the like of the double-sided loop surface fastener 2 are not particularly limited, and can be suitably decided depending on a size of an object to be fixed. From a viewpoint of ease of adjusting the length of the double-sided loop surface fastener and from a viewpoint of enhancing the handling property, it is preferable that the double-sided loop surface fastener which forms the fixing belt of this embodiment be formed of the double-sided loop surface fastener over the whole length thereof.

The width of the double-sided hook surface fastener 1 and the width of the double-sided loop surface fastener 2 are also not particularly limited. The widths may be adjusted suitably by increasing the widths when a heavy object or a large object is to be fixed and by reducing the widths when a lightweight object or a small object is to be fixed. Usually, the widths are selected from a width range of from 2 to 20 cm. It is preferable that the double-sided hook surface fastener 1 and the double-sided loop surface fastener 2 have the same width. It is also preferable that, when the width of the used double-sided hook surface fastener in use is increased, the number of rivets or the like mounted on the folded-back portion be increased in a width direction of the surface fastener along with the increase of the width. For example, when the double-sided hook surface fastener has a width of 2 to 3 cm, it is preferable that the rivet be provided to one place. When the double-sided hook surface fastener has a width of 3 to 6 cm, it is preferable that the rivets be provided to two to three portions at equal intervals in a width direction. When the double-sided hook surface fastener has a width of 6 to 10 cm, it is preferable that the rivets be provided to three to four portions at equal intervals in a width direction. When the double-sided hook surface fastener has a width of 8 to 20 cm, it is preferable that the rivets be provided to four or more portions.

The length of the double-sided hook surface fastener in use may be set to a length which is sufficient for the double-sided hook surface fastener to form an alligator's mouth by folding back the double-sided hook surface fastener, for enabling fixing of the folded-back portion by a rivet or the like, for allowing the double-sided loop surface fastener to be tucked by the alligator's mouth so that the double-sided loop surface fastener sufficiently engages with the double-sided hook surface fastener. Particularly, it is preferable for the double-sided hook surface fastener to have a length of 10 to 60 cm, particularly 15 to 40 cm before being folded back to acquire a sufficient engaging force.

In this embodiment, the mounting object (A) and the mounting object (B) may be parts of the same object which are continuously formed with each other or may be different objects which are not continuously formed with each other. When the mounting object (A) and the mounting object (B) are parts of the same object continuously formed with each other, the fixing belt of this embodiment can be used also as a fastening belt.

Next, the double-sided hook surface fastener used for the fixing belt of this embodiment is described.

First, the double-sided hook surface fastener used in this embodiment is a surface fastener manufactured by extrusion molding. Such an extrusion molding surface fastener has a large number of arrays of hook-like engaging elements which are made of a resin and are arranged parallel to each other in a length direction on both surfaces of a substrate made of the same resin. The extrusion molding surface fastener is manufactured by a method described later.

In this embodiment, the extrusion molding surface fastener is used from various viewpoints including the following viewpoints that a high engaging force can be acquired, that excellent flexibility can be acquired, that an excellent tensile strength in a length direction can be acquired, that a soft texture can be acquired, that a rivet hole formed at the time mounting the surface fastener on a mounting object is minimally enlarged during the use of the surface fastener, that the engagement and the peeling-off are uniformly distributed in a length direction, that a double-sided hook surface fastener having a desired free length can be obtained in a length direction, and that the extrusion molding surface fastener can be folded freely and the like.

With respect to the extrusion molding double-sided hook surface fastener used in this embodiment, usually, the substrate and the hook-like engaging elements provided to a front surface and a back surface of the substrate are all made of the same resin from a viewpoint of productivity and strength.

A resin used for forming the double-sided hook surface fastener is not particularly limited. A resin used for usual extrusion molding, for example, a synthetic resin such as ABS (acrylonitrile butadiene styrene), PC (polycarbonate), PA (polyamide), POM (polyoxymethylene), PP (polypropylene) or PBT (polybutylene terephthalate), or a polyamide-based resin such as nylon 6, and nylon 66 can be named, for example. Among these materials, a crystalline resin, particularly, a polyamide-based resin (nylon) and a polyester elastomer resin are preferably used from a viewpoint that excellent initial performance, a large engaging force and excellent flexibility are acquired, from a viewpoint that a hook-like engaging element and an umbrella portion of the hook-like engaging element are minimally torn thus exhibiting excellent durability, and from a viewpoint that soft texture is obtained.

Figure 4:
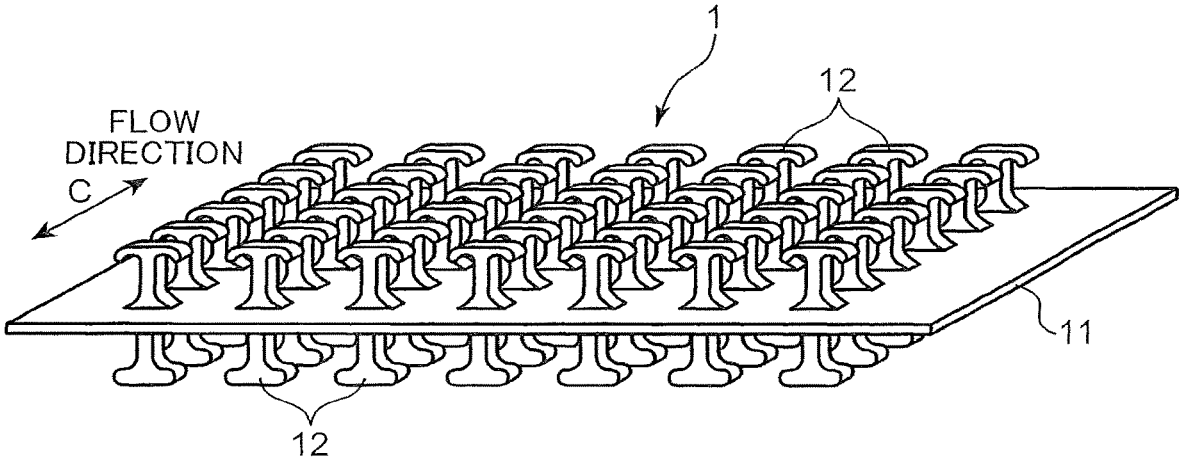
FIG. 4 is a schematic view showing one example of an arrangement state of hook-like engaging elements provided to surfaces of the double-sided hook surface fastener of this embodiment.
Figure 5:
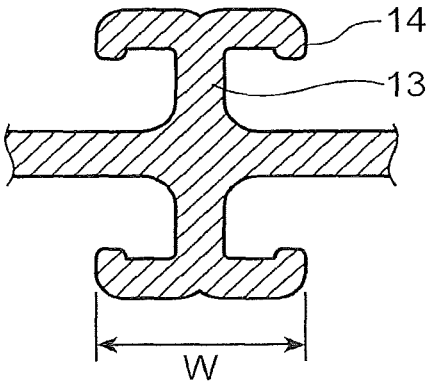
FIG. 5 is a schematic view showing one example of a shape of the hook-like engaging element which the double-sided hook surface fastener of this embodiment has.
Figure 6:
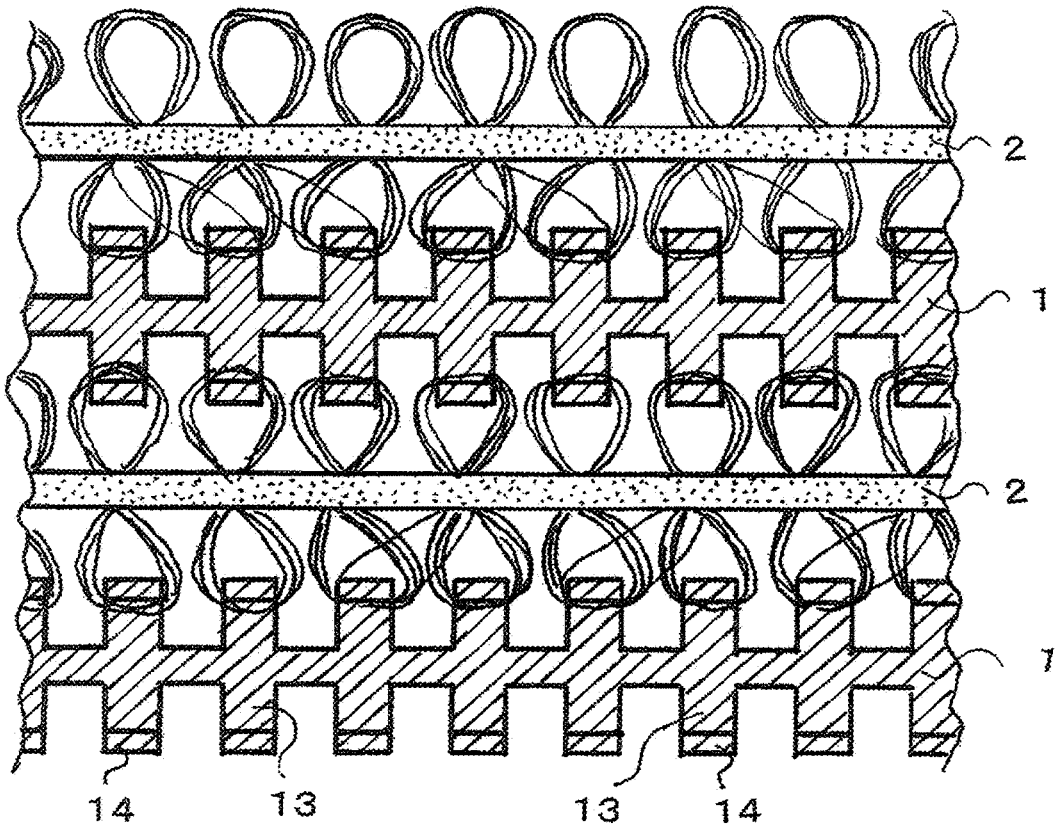
FIG. 6 is a schematic view showing one example of hook-like engaging elements of a double-sided hook surface fastener and loop-like engaging elements of a double-sided loop surface fastener engaging with each other.

In the extrusion molding double-sided hook surface fastener 1 of this embodiment, as shown in FIG. 4, the hook-like engaging elements 12 are arranged in an array on the front surface of the substrate 11. The shape of the hook-like engaging element 12 is not particularly limited. However, it is preferable that the hook-like engaging element 12 be a T-shaped engaging element formed of a stem portion and an umbrella portion which expands from an upper portion of the stem portion, for example. Specifically, as shown in FIG. 5, each T-shaped engaging element consists of a stem portion 13 and an umbrella portion 14 which expands from an upper portion of the stem portion 13, and the umbrella portion 14 expands in a protruding manner beyond a width of the stem portion 13 in a direction which intersects with an engaging element array direction. However, it is preferable that the umbrella portion not expand in an engaging element array direction, and the T-shaped engaging element has substantially the same width from the stem portion 13 to a distal end portion of the umbrella portion. A total width W which is a sum of a width of the stem portion 13 and widths of portions of the umbrella portion 14 which expand leftward and rightward from the stem portion 13 is set to approximately 0.50 to 1.00 mm. FIG. 6 shows one embodiment of T-shaped engaging elements each having the stem portion 13 and the umbrella portion 14 viewed from a direction parallel to the direction in which the umbrella portion 14 expands, the T-shaped engaging elements engaging with the loop-like engaging elements of the double-sided loop surface fastener 2.

With the use of such T-shaped hook-like engaging elements, it is possible to acquire an advantageous effect that the texture of the surface fastener becomes soft so that the surface fastener is minimally caught by other clothing fabric whereby the surface fastener minimally damages other clothing fabric, and an advantageous effect that a lint or the like minimally adheres to the surface fastener when the surface fastener rubs clothing or the like.

The double-sided hook surface fastener used in this embodiment is used in a state where the double-sided hook surface fastener is folded in an alligator's mouth shape. Accordingly, it is necessary for the double-sided hook surface fastener to has flexibility. To this end, it is preferable to set a thickness of the substrate which forms the double-sided hook surface fastener to 0.1 to 0.5 mm, and it is preferable to set a height of the hook-like engaging elements provided to the front surface and the back surface of the double-sided hook surface fastener to 0.2 to 1.0 mm. Further, it is preferable to set density (density on one surface) of the engaging elements provided to both surfaces of the substrate to 50 to 100 pieces/$cm^2$, and more particularly to 60 to 90 pieces/$cm^2$. In this manner, minute T-shaped hook-like engaging elements are provided to both surfaces of the substrate at high density and hence, it is possible to acquire a strong engaging force regardless of the soft texture of the double-sided hook surface fastener.

The double-sided hook surface fastener of this embodiment is manufactured by extrusion molding as described previously. Specifically, for example, by extruding a molten material of a resin from a nozzle having a space which has the same shape as the double-sided hook molded surface fastener of this embodiment (a nozzle where a T-shaped slit is arranged at vertically symmetrical positions on both surfaces of a slit extending transversely in a straight line shape) and by cooling the molten material thus acquiring a tape-shaped object having ridges for forming the T-shaped engaging elements each of which is continued in a length direction on upper and lower sides of the substrate. Cuttings each reaching a root portion from a distal end portion of the ridge for forming the T-shaped engaging elements are formed in each of the ridges for forming the T-shaped engaging elements on both surfaces of the tape-shaped object at small intervals, for example, intervals of 0.3 to 0.8 mm in a direction across the length direction of the ridge, and the tape is stretched by approximately 1.5 to 5 times as long as an initial length and, at the same time, is subjected to thermal treatment so that a shape of the tape after the stretching is fixed so that the double-sided hook surface fastener can be formed.

By extending the tape as described above, the ridges for forming the engaging elements are converted into an array of the engaging elements and hence, the tape can acquire an engaging force. When a resin which constitutes the tape is a crystalline resin such as polyamide or polyester elastomer, crystalline components of the substrate are oriented in the extending direction so that a strength of the tape in the length direction is increased and, at the same time, a thickness of the tape can be reduced. Simultaneously, a root portion of a stem of the engaging element is also extended along with the extension of the substrate and hence, it is possible to prevent the stem from being torn away from the root portion due to pulling at the time of releasing the engagement.

As the molded surface fastener, a surface fastener which is manufactured by injection molding is used in general. However, when a surface fastener is formed by injection molding, the surface fastener is manufactured using a method where a molten resin is made to flow into a cavity for forming engaging elements which is formed on a surface of a die, and after the molten resin is cured, the engaging elements are removed from the cavity and hence, a shape of the engaging element is limited to an inverse J shape for enabling the removal of the engaging element from the die. On the other hand, in the case where the extrusion molding surface fastener is used, the shape of the engaging element is not limited to such an inverse J shape, and the surface fastener having the T-shaped engaging elements as described previously can be easily manufactured. In the T-shaped engaging element, an engaging protrusion protrudes toward both sides of the stem and hence, there are many chances to engage with the loop-like engaging elements compared to the inverse-J-shaped engaging element so that an engaging force is increased corresponding to the number of such chances. Accordingly, the surface fastener having the T-shaped engaging elements is applicable to a fixing belt which is required to have a high engaging force, and more particularly to a fixing belt used in a medical equipment such as an artificial arm or an artificial leg.

Next, the double-sided loop surface fastener which becomes a counterpart of the above-mentioned double-sided hook surface fastener and is used for the fixing belt of this embodiment is described.

The double-sided loop surface fastener used in this embodiment is not particularly limited. It is possible to use a double-sided loop surface fastener which is formed by adhering two known loop surface fasteners to each other using a suitable adhesive agent or the like thus forming both surfaces thereof into a loop surface.

It is preferable to use loop surface fasteners each using a knitted fabric or a woven fabric as a substrate. Among such loop surface fasteners, it is preferable to use a loop surface fastener which uses a warp knitted fabric as a substrate and, particularly, a loop surface fastener using a tricot knitted fabric as a substrate where a large number of loops ca be formed on a surface.

As the tricot knitted fabric, a tricot fabric which has a loop pile layer formed of a multifilament on one surface thereof can be named. By applying raising treatment to the loop pile layer using wire clothing or the like, the multifilament which forms the loop pile layer is loosened thus enhancing an engaging force.

As fibers for forming the double-sided loop surface fastener, nylon-based fibers or polyester-based fibers are preferably used.

By overlapping base fabric layers of such loop surface fasteners to each other in a state where a loop layer of each loop surface fastener is allocated outside and by adhering the base fabric layers to each other using an adhesive agent, the double-sided loop surface fastener can be obtained. The double-sided loop surface fastener may be formed by overlapping the same loop surface fasteners with each other or may be formed by overlapping different kinds of loop surface fasteners with each other.

As an adhesive agent to be used, a solvent type adhesive agent, an emulsion type adhesive agent, or a hot melt type adhesive agent may be used. The hot melt type adhesive agent is preferably used from a viewpoint that the hot melt type adhesive agent exhibits favorable operability, from a viewpoint of the hot melt type adhesive agent not impairing engaging property and an external appearance of the loop surface fastener since the hot melt type adhesive agent does not seep onto the surface of the loop surface fastener and, further, from a viewpoint of the hot melt type adhesive agent preventing twisting and distortion of the surface fastener by imparting rigidity to the base fabric and the like.

In forming the double-sided loop surface fastener by joining the loop surface fasteners respectively formed of a tricot knitted fabric to each other, it is preferable to use the tricot knitted fabrics in such a manner that ridges of the base fabrics of the tricot fabrics are arranged parallel to each other in a width direction of the belt from a viewpoint of acquiring dimensional stability in a length direction of the belt and rigidity of the double-sided loop surface fastener.

The double-sided loop surface fastener which forms the fixing belt of this embodiment and the double-sided loop surface fastener which forms the above-mentioned reinforcing member may be equal to each other or different from each other. However, it is preferable to use the same double-sided loop surface fasteners from viewpoints of improving efficiency of production process, enhancing engageability of the double-sided loop surface fastener with the double-sided hook surface fastener, and lowering a cost.

The fixing belt of this embodiment can be used for various applications. For example, the fixing belt is preferably applicable to fixing of medical equipment such as an artificial arm or an artificial leg, a packing material or the like.

To describe one example of fixing of the artificial leg, a cutout is formed on a front side of a resin-made equipment body to which a part of a lower limb of a human is to be fixed. The cutout is formed for making the insertion of the lower limb of a human into the equipment body easy. The plurality of fixing belts of this embodiment are provided in such a manner that the fixing belts extend so as to span the cutout for fixing a human body and the equipment body to each other. The alligator's mouth of the fixing belt is fixed to the equipment body by the rivet or the like at the position on a side of the cutout of the equipment body. The annular part is mounted on the equipment body on a side opposite to the fixing position of the belt with the cutout tucked therebetween. With such a configuration, the equipment body can be fixed to the lower limb in such a manner that one end of the double-sided loop surface fastener is inserted into the above-mentioned alligator's mouth, the hook-like engaging elements provided to both inner surfaces of the alligator's mouth and the loop-like engaging elements of the double-sided loop surface fastener are made to engage with each other, the double-sided loop surface fastener is folded back from the annular part so as to fasten the cutout, and the other end portion of the double-sided loop surface fastener is made to engage with the hook-like engaging elements disposed outside the double-sided hook surface fastener.

The present invention includes a fixing method using the fixing belt. Specifically, in a method for fixing a mounting object (A) to a mounting object (B) using an extrusion molding double-sided hook surface fastener having hook-like engaging elements on both surfaces thereof and a double-sided loop surface fastener having loop-like engaging elements on both surfaces thereof, using the double-sided hook surface fastener, the double-sided loop surface fastener fixes the mounting object (A) to the mounting object (B) in such a manner that one end portion of the double-sided loop surface fastener is tucked by the alligator's mouth, and the double-sided loop surface fastener is folded back by an annular part fixed to the mounting object (B), and the other end portion of the double-sided loop surface fastener engages with an outer side surface of the alligator's mouth.

Further, the present invention also includes a fixing belt member which forms the fixing belt. Specifically, there is provided a fixing belt member where an alligator's mouth is formed by folding back a double-sided hook surface fastener having hook-like engaging elements on both surfaces thereof in a length direction, and a folded-back state of the double-sided hook surface fastener is fixed by a double-sided loop surface fastener inserted into a deep side of a folded-back portion, wherein in the double-sided hook surface fastener, the hook-like engaging elements are arranged on both surfaces of a substrate in an array in a surface fastener length direction, the hook-like engaging element is a T-shaped engaging element which consists of a stem portion and an umbrella portion expanding from an upper portion of the stem portion, and the umbrella portion protrudes beyond a width of the stem portion in a direction which intersects with an engaging element array direction, the substrate and the engaging elements consist of a same crystalline resin, and crystals of the resin which constitutes the substrate are oriented in the surface fastener length direction.

Although this specification discloses techniques of various modes as described above, the main techniques among the above-mentioned techniques are recapitulated as follows.

That is, a fixing belt according to an aspect of the present invention is a fixing belt which includes: a double-sided hook surface fastener having hook-like engaging elements on both surfaces thereof; and a double-sided loop surface fastener having loop-like engaging elements on both surfaces thereof, wherein the double-sided hook surface fastener is an extrusion molding surface fastener, is folded back in a length direction in a shape of an alligator's mouth, and is fixed to a mounting object (A) at a folded-back portion, and the double-sided loop surface fastener has one end portion tucked by the alligator's mouth, is folded back by an annular part fixed to a mounting object (B), and has the other end portion engaging with an outer side surface of the alligator's mouth.

With such a configuration, a length of the belt can be easily adjusted and, further, exchange of the surface fastener can be performed simply at a low cost. Further, even when engagement and peeling-off of the double-sided hook surface fastener are repeated, the double-sided hook surface fastener is minimally broken, and the double-sided hook surface fastener and the double-sided loop surface fastener are easily brought into close contact with each other thus acquiring a high engaging force.

Further, in the fixing belt, it is preferable that the extrusion molding surface fastener be made of a resin such as polyamide or polyester elastomer. With such a configuration, the surface fastener can acquire advantageous effects such as an excellent initial performance, a high engaging force, high flexibility. The surface fastener also can acquire an advantageous effect that the hook-like engaging elements and the umbrella portions of the engaging elements are minimally broken and hence, the surface fastener can acquire excellent durability, and an advantageous effect that the surface fastener also can possess soft texture.

In the fixing belt, it is preferable that the reinforcing member be tucked in the folded-back portion. With such a configuration, the folded-back portion is reinforced. Accordingly, even in a state where a strong force is instantaneously applied to the fixing belt when the fixing belt is used, it is possible to acquire an advantageous effect that the double-sided hook surface fastener is prevented from being torn from the rivet portion where the rivet is mounted in the through hole of the double-sided hook surface fastener.

Further, it is preferable that the reinforcing member be formed of the double-sided loop surface fastener. With such a configuration, it is also possible to acquire an advantageous effect that a cost can be suppressed, and it is also possible to acquire an advantageous effect that the reinforcing member can be easily positioned by temporarily fixing the reinforcing member.

In the fixing belt, it is preferable that the double-sided hook surface fastener be fixed to the mounting object (A) by the rivet which penetrates the mounting object (A), two double-sided hook surface fastener portions of the double-sided hook surface fastener in front of and behind the folded-back portion of the double-sided hook surface fastener, and the reinforcing member tucked between the double-sided hook surface fastener portions.

In the above-mentioned configuration, provided that the reinforcing member consists of the double-sided loop surface fastener, on the periphery of the rivet-use through hole, due to the engagement between the double-sided hook surface fastener and the double-sided hook surface fastener as the reinforcing member which form the fixing belt, these constitutional elements are integrally formed with each other thus also acquiring an advantageous effect that it is possible to prevent the double-sided hook surface fastener from torn from the rivet-use through hole with high reliability.

In the fixing belt, it is preferable that the hook-like engaging element be a I-shaped engaging element which consists of a stem portion and an umbrella portion which expands from an upper portion of the stem portion, the umbrella portion expanding beyond the width of the stem portion in a direction which intersects with the engaging element array direction, a total width which is a sum of the width of the stem portion and widths of portions of the umbrella portion expand leftward and rightward being set to 0.50 to 1.00 mm, the umbrella portion not expanding in the engaging element array direction.

With such a configuration, it is possible to acquire an advantageous effect that the belt can be obtained where the texture of the belt is soft so that the belt is minimally caught on by other clothing fabric whereby the belt minimally damages other clothing fabric, and a lint or the like minimally adheres to the belt when the belt rubs on clothing or the like.

A fixing method according to another aspect of the present invention is directed to a method for fixing a mounting object (B) to a mounting object (A) using an extrusion molding double-sided hook surface fastener having hook-like engaging elements on both surfaces thereof and a double-sided loop surface fastener having loop-like engaging elements on both surfaces thereof, wherein using the double-sided hook surface fastener being folded back in a length direction in a shape of an alligator's mouth and fixed to the mounting object (A) at a folded-back portion, the double-sided loop surface fastener fixes the mounting object (A) to the mounting object (B) in such a manner that one end portion of the double-sided loop surface fastener is tucked by the alligator's mouth, the double-sided loop surface fastener is folded back by the annular part fixed to the mounting object (B), and another end portion of the double-sided loop surface fastener engages with the outer side surface of the alligator's mouth.

With such a configuration, even when an engaging force is lowered due to raising and loop cutting of the double-sided loop surface fastener caused by repeated use of the double-sided loop surface fastener, the double-sided loop surface fastener can be exchanged and hence, it is possible to acquire an advantageous effect that maintenance of the fixing belt can be easily performed.

Further, a fixing belt member according to still another aspect of the present invention is directed to a fixing belt member in which a double-sided hook surface fastener having hook-like engaging elements on both surfaces thereof is folded back in a length direction in a shape of an alligator's mouth, and a folded-back state of the double-sided hook surface fastener is fixed by the double-sided loop surface fastener inserted into a deep side of a folded-back portion, wherein in the double-sided hook surface fastener, the hook-like engaging elements are arranged on both surfaces of the substrate in an array in the surface fastener length direction, the hook-like engaging element is the T-shaped engaging element which consists of the stem portion and the umbrella portion expanding from the upper portion of the stem portion, the umbrella portion protruding beyond the width of the stem portion in the direction which intersects with the engaging element array direction, and the substrate and the engaging elements consist of the same crystalline resin, and crystals of the resin which constitutes the substrate are oriented in the surface fastener length direction.

With such a configuration, there are many chances for the hook-like engaging elements to engage with the loop-like engaging elements of the double-sided loop surface fastener thus acquiring an advantageous effect that a high engaging force can be acquired.

Hereinafter, the present invention is described in more detail using examples. However, the scope of the present invention is not limited by the following examples.

EXAMPLES

Test Example 1: Tensile Shear Strength and Peeling-Off Strength (Manufacture of Double-Sided Hook Surface Fastener 1)

A molten nylon-6 resin (UBESTA made by UBE INDUSTRIES, LTD., bending elastic modulus: 400 MPa) was extruded in a molten state from a nozzle where T-shaped slits are disposed at vertically symmetrical positions (46 stem-use slits existing on substrate-use slit equidistantly), the extruded nylon-6 resin was cooled so that a tape on which stem-use and protrusion-use ridges each having a T shape in cross section are formed on a surface of the tape is formed in a state where each T-shaped ridge consists of a stem protruding from a front surface and a back surface of a substrate and a protruding portion extending in a direction parallel to the substrate continuously from a distal end portion of the stem. Then, cuts are formed in the tape at equal interval of 0.5 mm with a cutting angle of 30° from a distal end to a root portion of each ridge on the tape. Then, the tape is stretched in a heated state in a length direction 2.2 times of an initial length so that the double-sided hook surface fastener 1 was manufactured.

In the obtained double-sided hook surface fastener, a thickness of the substrate was 0.3 mm, each hook-like engaging element was a T-shaped engaging element which consists of a stem portion and an umbrella portion which expands from an upper portion of the stem portion, wherein the umbrella portion expanded beyond a width of the stem portion in a direction inclined by 60° from the engaging element array direction, a total width which was a sum of a width of the stem portion and widths of portions of the umbrella portion expanding leftward and rightward is 0.7 mm, and the umbrella portion did not expand in the engaging element array direction. Further, a height of the hook-like engaging element from the substrate was 0.45 mm, and element density (element density on one surface) of the hook-like engaging elements was 79/cm$^2$.

(Manufacture of Double-Sided Hook Surface Fastener 2)

A molten polyester elastomer (HYTREL made by TORAY AND DUPONT CORPORATION, bending elastic modulus: 540 MPa) was extruded in a molten state from a nozzle where T-shaped slits are disposed at vertically symmetrical positions (46 stem-use slits existing on substrate-use slit equidistantly), the extruded nylon-6 resin was cooled so that a tape on which stem-use and protrusion-use ridges each having a T shape in cross section are formed on a surface of the tape is formed in a state where each T-shaped ridge consists of a stem protruding from a front surface and a back surface of a substrate and a protruding portion extending in a direction parallel to the substrate continuously from a distal end portion of the stem. Then, cuts are formed in the tape at equal interval of 0.5 mm with a cutting angle of 30° from a distal end to a root portion of each ridge on the tape. Then, the tape is stretched in a heated state in a length direction 2.2 times of an initial length so that the double-sided hook surface fastener 2 was manufactured.

In the obtained double-sided hook surface fastener, a thickness of the substrate was 0.3 mm, each hook-like engaging element was a T-shaped engaging element which consists of a stem portion and an umbrella portion which expands from an upper portion of the stem portion, wherein the umbrella portion expanded beyond a width of the stem portion in a direction inclined by 60° from the engaging element array direction, a total width which was a sum of a width of the stem portion and widths of portions of the umbrella portion expanding leftward and rightward was 0.7 mm, and the umbrella portion did not expand in the engaging element array direction. Further, a height of the hook-like engaging element from the substrate was 0.45 mm, and element density (element density on one surface) of the hook-like engaging elements was 69/cm$^2$.

In the obtained double-sided hook surface fasteners 1 and 2, the substrate of the double-sided hook surface fastener was extended in the engaging element array direction and hence, crystals of the nylon resin or the polyester elastomer resin were oriented in the engaging element array direction. Accordingly, the double-sided hook surface fasteners 1, 2 had a high strength in the engaging element array direction, and there was no possibility that the substrate was damaged by repetition of engagement, peeling-off and stretching of the substrate. Further, the umbrella portion of the engaging element protruded in a direction inclined by an angle of 60° from the engaging element array direction and hence, the umbrella portion could easily engage with the loop-like engaging elements so that, even when a tensile force of the loop surface fastener was loosened, engagement was minimally released thus also acquiring a high engaging force. Further, each engaging element had a T shape, a height of the engaging element was low, and the engaging elements ware provided at high density and hence, the hook surface fastener could give an extremely soft texture to a user so that, even when a user touched the hook surface fastener at the time of using the fixing belt, the user could touch the hook surface fastener with substantially the same texture as texture at the time of touching a smooth resin sheet.

(Manufacture of Double-Sided Loop Surface Fastener 1)

A double-sided loop surface fastener 1 was manufactured by adhering, to a back surface of a knitted female-type surface fastener where multifilament loops to be formed as the loop-like engaging elements were formed on a front surface of a tricot knitted base fabric (E40000 made by Kuraray Fastening Co., Ltd, basis weight: 285±15 g/m$^2$, density[W]: 52±2/2.54 cm, density[C]: 48±2/2.54 cm), a surface of the same tricot knitted female-type surface fastener was laminated such that a surface where loops were formed was disposed on an outer side, and ridges of the base fabrics of both tricot knitted fabrics extended parallel to each other in a width direction using a hot-melt-basis adhesive agent.

(Manufacture of Double-Sided Loop Surface Fastener 2)

A double-sided loop surface fastener 2 was manufactured by adhering, to a back surface of a knitted female-type surface fastener where multifilament loops to be formed as the loop-like engaging elements were formed on a front surface of a tricot knitted base fabric (E5000C made by Kuraray Fastening Co., Ltd, basis weight: 190±10 g/m$^2$, density[W]: 47 to 56/2.54 cm, density[C]: 34±2/2.54 cm), the same tricot knitted female-type surface fastener was laminated such that a surface where loops were formed was disposed on an outer side, and ridges of the base fabrics of both tricot knitted fabrics extended parallel to each other in a width direction using a hot-melt-basis adhesive agent.

Example 1

Using the double-sided hook surface fastener 1 and the double-sided loop surface fastener 1 obtained by the above-mentioned manufacturing methods, a tensile shear strength and a peeling strength were measured after the first time peeling was performed, after the peeling was performed 10,000 times, and after the peeling was performed 20,000 times respectively in accordance with JIS-L-3416 (Revised in 2000). The measurement results are shown in Table 1.

In the following Table 1 and Table 2 described below, average values of "tensile shear strength" are average values of the measurement results obtained while assuming N as 3 times. With respect to the measurement results of the tensile shear strength, average values are calculated while assuming an area where hooks and loops overlap each other as 20 mm×50 mm (10 $cm^2$), and values obtained by converting the average values into N/$cm^2$ are described on a right side of the average values respectively.

Also with respect to average values of a peeling strength, the average values are average values of the measurement results obtained while assuming N as 3 times. Further, with respect to the measurement results of the peeling strength, average values were calculated while assuming a measuring width as 20 mm (N/20 mm), and values obtained by dividing the respectively average values by two and by converting the values obtained by such division into N/cm were described on the right side of the average values.

TABLE 1

| | | HOOK DOUBLE-SIDED HOOK SURFACE FASTENER 1 LOOP DOUBLE-SIDED LOOP SURFACE FASTENER 1 | | |
|---|---|---|---|---|
| EXAMPLE 1 | NUMBER OF TIMES OF PEELING | AVERAGE | N/$cm^2$ N/cm | RETENTION RATIO WITH RESPECT TO VALUE OF FIRST TIME |
| <SHEAR> | FIRST TIME | 391.3 | 39.13 | — |
| (N/20 × 50 mm) | 10000 TIMES | 368.0 | 36.80 | 94.1% |
| | 20000 TIMES | 359.0 | 35.90 | 91.7% |
| <PEEL> | FIRST TIME | 2.32 | 1.16 | — |
| (N/20 mm) | 10000 TIMES | 1.92 | 0.96 | 82.9% |
| | 20000 TIMES | 2.23 | 1.11 | 96.0% |

Example 2

Using the double-sided hook surface fastener 2 and the double-sided loop surface fastener 2 obtained by the above-mentioned methods, a tensile shear strength and a peeling strength were measured after the first time peeling was performed, after the peeling was performed 5,000 times, after the peeling was performed 10,000 times, after the peeling was performed 15,000 times, and after the peeling was performed 20,000 times respectively in accordance with JIS-L-3416 (Amended on 2000). The measurement results are shown in Table 2.

Example 3

Using the double-sided hook surface fastener 2 and the double-sided loop surface fastener 1 obtained by the above-mentioned methods, a tensile shear strength and a peeling strength were measured after the first time peeling was performed, after the peeling was performed 5,000 times, after the peeling was performed 10,000 times, after the peeling was performed by 15,000 times, and after the peeling was performed by 20,000 times respectively in accordance with JIS-L-3416 (Amended on 2000). The measurement results are shown in Table 2.

TABLE 2

| | | HOOK DOUBLE-SIDED HOOK SURFACE FASTENER 2 LOOP | | | | | |
|---|---|---|---|---|---|---|---|
| | NUMBER OF | DOUBLE-SIDED LOOP SURFACE FASTENER 2 | | | DOUBLE-SIDED LOOP SURFACE FASTENER 1 | | |
| | TIMES OF PEELING | AVERAGE | N/$cm^2$ N/cm | RETENTION RATIO | AVERAGE | N/$cm^2$ N/cm | RETENTION RATIO |
| <SHEAR> | FIRST TIME | 305.7 | 30.57 | — | 292.5 | 29.25 | — |
| (N/20 × 50 mm) | 5000 TIMES | 280.7 | 28.07 | 91.8% | 270.9 | 27.09 | 92.6% |
| | 10000 TIMES | 273.8 | 27.38 | 89.6% | 294.8 | 29.48 | 100.8% |
| | 15000 TIMES | 271.9 | 27.19 | 88.9% | 275.8 | 27.58 | 94.3% |
| | 20000 TIMES | 274.2 | 27.42 | 89.7% | 269.6 | 26.96 | 92.2% |
| <PEEL> | FIRST TIME | 3.16 | 1.58 | — | 2.99 | 1.49 | — |
| (N/20 mm) | 5000 TIMES | 2.50 | 1.25 | 79.2% | 1.79 | 0.89 | 59.8% |
| | 10000 TIMES | 2.75 | 1.37 | 86.9% | 2.08 | 1.04 | 69.5% |
| | 15000 TIMES | 2.26 | 1.13 | 71.7% | 1.89 | 0.95 | 63.4% |
| | 20000 TIMES | 2.45 | 1.22 | 77.5% | 1.53 | 0.77 | 51.3% |

(Observations)

As the results of measurement, large fluffing of the loops, removal and chipping of the hooks were found in none of the examples even when the confirmation was made by an enlarged photographs obtained after the peeling was performed 20,000 times, and a damage could be suppressed to an extent that the deformation was found in an end portion of an umbrella portion of an engaging element. Particularly, in the example 1, the result was obtained where respective strength retention ratios after the peeling was performed 20,000 times were 80% or more of the values after the first time peeling was performed, and it was also found that the further excellent results can be obtained when a polyamide resin was used for forming the surface fastener.

Test Example 2: Strength of Rivet Portion

An alligator's mouth having a shape shown in FIG. 1 was manufactured with two kinds of belt widths (width: 25 mm, rivet diameter: 3 mm, the number of rivets: 1, and width: 50 mm, rivet diameter: 3 mm, the number of rivets: 2) in accordance with the combinations of sandwiching parts shown in the following Table 3. For reinforcing rivet holes of the alligator's mouth, the double-sided loop surface fastener 1 (length: 25 mm, width: 25 mm) was inserted into an alligator's mouth portion as a reinforcing member, rivet mounting holes were formed so as to penetrate two double-sided hook surface fastener portions in front of and behind a folded back portion of the alligator's mouth and the double-sided loop surface fastener inserted between two double-sided hook surface fastener portions as the reinforcing member. Then, in a fastener strength measuring test of the rivet portion where the rivets were mounted in the rivet mounting holes of the alligator-mouth-shaped member and the rivet portion was pulled by applying a wire to the rivet portion, evaluation was performed by performing a rivet portion strength measurement where the alligator-mouth-shaped member was pulled downward and the wire was pulled upward using a tester (Autograph) at a speed of 300 mm/min. In Table 3, data obtained in the case where the reinforcing member was not inserted is also described.

In the test example 2, since the folded-back state of the double-sided hook surface fastener was fixed by the double-sided loop surface fastener used as the reinforcing member, there was no possibility that the positional displacement occurs and hence, in mounting the rivets, extremely excellent operability was obtained compared to the case where the reinforcing member was not inserted.

In the qualified/disqualified state determination, a state where the rivet was removed but the fastener was not torn (removal of rivet) when a tensile strength measurement value reached a peak was determined as a qualified state.

TABLE 3

| COMBINATIONS OF SANDWICHING PARTS | | BELT HAVING WIDTH OF 25 mm | BELT HAVING WIDTH OF 50 mm |
|---|---|---|---|
| SURFACE FASTENER (BELT) | REINFORCING MEMBER | RIVET (φ3 mm) AT ONE PORTION MEASURED VALUE PEELING-OFF STATE | RIVET (φ3 mm) AT TWO PORTION MEASURED VALUE PEELING-OFF STATE |
| HOOK SURFACE FASTENER 1 | LOOP SURFACE FASTENER 1 ADHERED PRODUCT | 437N REMOVAL OF RIVET | 872N REMOVAL OF RIVET |
| | NATURAL LEATHER | 466N REMOVAL OF RIVET | 824N REMOVAL OF RIVET |
| | NOTHING | 317N RUPTURE OF FASTENER | 608N RUPTURE OF FASTENER |
| QUALIFIED/ DISQUALIFIED STATE DETERMINATION | NO RUPTURE OF FASTENER AT THE TIME OF PERFORMING MEASUREMENT | | |

(Observations)

As can be understood from the Table 3, when the loop surface fastener 1 was used as the reinforcing member of the fixing belt of the present invention, a rivet portion strength was substantially equal to a rivet portion strength when a natural leather was used as the reinforcing member.

When the natural leather was used, the natural leather did not have an ability of engaging with the hook surface fastener and hence, the positional displacement is likely to occur at the time of forming the rivet holes or at the time of inserting the rivets and hence, the natural leather was inferior to the loop surface fastener in operability.

[In-Use Example of Fixing Belt to Artificial Leg]

An in-use example of the fixing belt where the fixing belt was used as a fixing belt of an equipment body made of polypropylene to which a part of a lower limb is fixed is described. That is, a cutout for making the lower limb easily inserted into the equipment body is formed on a front side of the equipment body and, then, for fixing a human body to the equipment body, three fixing belts of the present invention were mounted on the equipment body so as to span the cutout.

Specifically, in the same manner as the manufacture in the above-mentioned test example 2, the double-sided hook surface fastener 1 having a width of 50 mm and a length of 250 mm was folded back in twofold in a length direction thus being formed into an alligator's mouth, rivet holes having a diameter of 3 mm were formed at two portions away from each other by 30 mm in parallel in a width direction at positions away from the folded back portion by 10 mm and, then, the double-sided loop surface fastener 1 (length: 25 mm, width: 50 mm) to be formed as a reinforcing member was tucked by the folded back portion. At the same time, rivet holes were also formed in the double-sided loop surface fastener at the same positions as the rivet holes formed in the double-sided hook surface fastener 1, and fixing belts manufactured as described above were fixed to positions on a side portion of the cutout of the equipment body using rivets which were allowed to pass through these holes. Then, annular parts were mounted on the equipment body on a side opposite to the fixing positions of the belts with the cutout tucked between the fixing belts and the annular members.

Next, one terminal end of each double-sided loop surface fastener 1 was inserted into the above-mentioned alligator's mouth, and the hook-like engaging elements on an inner side of the alligator's mouth and the loop-like engaging elements of the inserted double-sided loop surface fastener 1 are made to engage with each other and hence, one end portion of the double-sided loop surface fastener 1 was fixed to the alligator's mouth and, at the same time, the double-sided loop surface fastener was folded back by the annular part, the cutout was fastened by fastening the double-sided loop surface fastener, and in such a state, the other end portion of the double-sided loop surface fastener was made to engage with the hook-like engaging elements on an outer side of the double-sided hook surface fastener 1 thus fixing the equipment body.

As a result, the adjustment of a length of the belt and the adjustment of a fastening state of the belt can be easily performed and, further, when the double-sided loop surface fastener is damaged, the double-sided loop surface fastener can be easily exchanged. Further, even when the engagement and peeling-off of the surface fastener are repeated, neither rupture nor breaking occurs in the hook-like engaging element, a substrate layer of the surface fastener, and the rivet portion on the hook surface fastener side. The hook surface fastener is flexible and hence, the hook surface fastener is easily brought into close contact with the loop surface fastener whereby an extremely high engaging force can be acquired. Further, engaging elements provided to the front surface of the double-sided hook surface fastener are small and hence, the engaging elements are provided at high density, and the hook surface fastener per se is flexible and hence, the hook surface fastener can impart soft texture hand and skin. Accordingly, when a user strongly touches the hook surface fastener at the time of engaging or peeling off the hook surface fastener, the hook surface fastener does not apply any stimulus to the user at all.

This application is based on Japanese Patent Application No. 2017-23090, filed on Feb. 10, 2017, and the contents the application is incorporated herein.

In order to express the present invention, the present invention has been described appropriately and sufficiently through embodiments with reference to the specific examples and the like heretofore. However, it must be noted that the above embodiments can be easily made by those skilled in the art, and it should be noted that the embodiments are changed and/or improved by those who are skilled in the art. Accordingly, modifications or improvements which those who are skilled in the art carry out fall within the scope of claims unless the modifications or improvements are at such a level that the modifications or improvements depart from the scope of claims.

INDUSTRIAL APPLICABILITY

The present invention has wide industrial applicability in technical fields such as a fixing belt, a fixing belt member and the like.

The invention claimed is:

1. A fixing belt assembly, comprising:

a double-sided hook surface fastener having engaging elements comprising hooks on both surfaces thereof; and a double-sided loop surface fastener having engaging elements comprising loops on both surfaces thereof, wherein the double-sided hook surface fastener is an extrusion molding surface fastener, the double-sided hook surface fastener is folded back in a length direction to form a Y shape and fixed to a first mounting object at a folded-back portion, the double-sided loop surface fastener is passed through an annular part and folded back in a length direction thereof, where the annular part is fixed to a second mounting object via a mounting object connecting member, such that the folded back double-sided loop surface fastener is fixed to the second mounting object, an end portion of the folded back double-sided loop surface fastener is tucked inside between a first part and a second part of the Y shaped folded back double-sided hook surface fastener, such that the hook engaging elements disposed on an inner side of the first and second parts of the Y shaped folded back double-sided hook surface fastener and the loop engaging elements on the end portion of the folded back double-sided loop surface fastener tucked inside the Y shape are engaged with each other and that the end portion of the folded back double-sided loop surface fastener is removably fixed inside the Y shaped folded back double-sided hook surface fastener, the other end portion of the folded back double-sided loop surface fastener is placed on an outer side of the first part of the Y shape, such that the hook engaging elements disposed on the outer side of the first part of the Y shaped folded back double-sided hook surface fastener and the loop engaging elements on the other end portion of the folded back double-sided loop surface fastener are removably engaged with each other, and that the end portions of the folded back double-sided loop surface fastener are removably fixed to the first and second parts of the Y shaped folded back double-sided hook surface fastener, and the folded back double-sided loop surface fastener passed through the annular part is not fixed except that the end portions thereof are removably fixed to the Y shaped folded back double-sided hook surface fastener.

2. The fixing belt assembly of claim 1, wherein the hook surface fastener is made from a polyamide elastomer or a polyester elastomer.

3. The fixing belt assembly of claim 1, further comprising:

a reinforcing member inserted between the first and second parts of the Y shaped folded back double-sided hook surface fastener in the folded-back portion.

4. The fixing belt assembly of claim 3, wherein the reinforcing member consists of a double-sided loop surface fastener having engaging elements comprising loops on both sides thereof.

5. The fixing belt assembly of claim 3, wherein the double-sided hook surface fastener is fixed to the first mounting object by at least one rivet which penetrates the first mounting object, the first and second parts of the Y shaped folded back double-sided hook surface fastener, and the reinforcing member.

6. The fixing belt assembly of claim 1, wherein each of the engaging elements comprising hooks has a T-shape having a stem portion and a protruding portion expanding from an upper portion of the stem portion beyond a width of the stem portion in a direction which intersects with an array direction of the hooks, wherein a width W of the protruding portion in the direction which intersects with the array direction of the hooks is from 0.50 to 1.00 mm, and wherein the protruding portion does not expand in the array direction of the hooks.

7. A method for fixing a second mounting object to a first mounting object, the method comprising:

folding back a double-sided hook surface fastener having engaging elements comprising hooks on both surfaces thereof in a length direction to form a Y shape, and fixing the Y shaped folded back double-sided hook surface fastener to the first mounting object at a folded-back portion, where the hook surface fastener is an extrusion molding surface fastener;

passing a double-sided loop surface fastener having engaging elements comprising loops on both surfaces thereof through an annular part, and folding back the loop surface fastener passed through the annular part in a length direction thereof, where the annular part is fixed to the second mounting object by a mounting object connecting member, thereby fixing the folded back double-sided loop surface fastener to the second mounting object;

tacking an end portion of the double-sided loop surface fastener between a first part and a second part of the Y shaped folded back double-sided hook surface fastener, and engaging the hook engaging elements disposed on an inner side of the first and second parts of the Y shaped folded back double-sided hook surface fastener and the loop engaging elements on the end portion of the double-sided loop surface fastener tucked inside the Y shape with each other, such that the end portion of the double-sided loop surface fastener is removably fixed inside the Y shaped folded back double-sided hook surface fastener; and placing the other end portion of the double-sided loop surface fastener passed through the annular part on an outer side of the first part of the Y shape, such that the hook engaging elements disposed on the outer side of the first part of the Y shaped folded back double-sided hook surface fastener and the loop engaging elements on the other end portion of the double-sided loop surface fastener are removably attached to each other, thereby removably fixing the end portions of the double-sided loop surface fastener to the first and second parts of the Y shaped folded back double-sided hook surface fastener, wherein the double-sided loop surface fastener passed through the annular part is not fixed except that the end portions thereof are removably fixed to the Y shaped folded back double-sided hook surface fastener.

8. The fixing belt assembly of claim 1, wherein the hooks of the double-sided hook surface fastener are arranged on a substrate to form a plurality of arrays parallel to each other in the length direction of the double-sided hook surface fastener on both surfaces, where the substrate and the hooks are made of a same resin, and the double-sided loop surface fastener is formed by adhering two loop surface fasteners each having a loop pile layer formed of a multifilament on one surface, to each other, thereby forming the double-sided loop surface fastener having the loops on the both surfaces.

9. The fixing belt assembly of claim 1, wherein the first mounting object and the second mounting object are different objects which are not continuously formed with each other.

10. The fixing belt assembly of claim 9, wherein one of the first mounting object and the second mounting object is an artificial arm or an artificial leg.

11. The fixing belt assembly of claim 1, wherein the hook surface fastener is fixed to the first mounting object by at least one rivet which penetrates the first mounting object and the folded-back portion of the Y shaped folded back double-sided hook surface fastener.

* * * * *